US010830224B2

(12) United States Patent
Klaus et al.

(10) Patent No.: US 10,830,224 B2
(45) Date of Patent: Nov. 10, 2020

(54) COMPRESSOR SYSTEM FOR GENERATING COMPRESSED AIR, AS WELL AS METHOD FOR OPERATING A COMPRESSOR SYSTEM THAT GENERATES COMPRESSED AIR

(71) Applicant: GARDNER DENVER DEUTSCHLAND GMBH, Bad Neustadt (DE)

(72) Inventors: Frank Georg Klaus, Zell-Barl (DE); Jürgen Tries, Heinzenbach (DE); Lars Horst, Büchel (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 336 days.

(21) Appl. No.: 15/569,640

(22) PCT Filed: Mar. 30, 2016

(86) PCT No.: PCT/EP2016/056850
§ 371 (c)(1),
(2) Date: Oct. 26, 2017

(87) PCT Pub. No.: WO2016/156350
PCT Pub. Date: Oct. 6, 2016

(65) Prior Publication Data

US 2018/0128253 A1 May 10, 2018

(30) Foreign Application Priority Data

Mar. 30, 2015 (DE) ..... 10 2015 104 914

(51) Int. Cl.
*F04B 39/06* (2006.01)
*F04C 29/12* (2006.01)
(Continued)

(52) U.S. Cl.
CPC ..... *F04B 39/066* (2013.01); *F01C 21/007* (2013.01); *F04B 39/06* (2013.01);
(Continued)

(58) Field of Classification Search
CPC ..... F04D 29/04; F04C 29/047; F04C 29/12; F04C 2270/20; F04C 2240/30; F04C 18/16; F01C 21/007
See application file for complete search history.

(56) References Cited

U.S. PATENT DOCUMENTS 6,077,052 A † 6/2000 Gunn
6,604,911 B2 * 8/2003 Pauwels ..... F04B 39/06 165/299
8,313,312 B2 * 11/2012 Fujimoto ..... F04B 39/0033 417/321
8,622,716 B2 † 1/2014 Tanaka
(Continued)

FOREIGN PATENT DOCUMENTS

CN 2298494 Y 11/1998
CN 101900101 A 12/2010
(Continued)

OTHER PUBLICATIONS

International Search Report and Written Opinion for Application No. PCT/EP2016/056850 dated Jul. 5, 2016 (8 pages).

*Primary Examiner* — Patrick Hamo
(74) *Attorney, Agent, or Firm* — Michael Best & Friedrich LLP

(57) ABSTRACT

The invention relates to a compressor system for generating compressed air. It comprises a drive, a driven compressor, a lubricant cooler, a compressed air cooler and a blower unit. The blower unit has at least two blowers that can be controlled independent of one another, which convey cooling air to first and second cooling chambers that are separated from one another, wherein the first cooling chamber conveys the cooling air to the lubricant cooler, and the second cooling chamber conveys the cooling air to the compressed air cooler. The lubricant cooler and the com-
(Continued)

Figure 1:
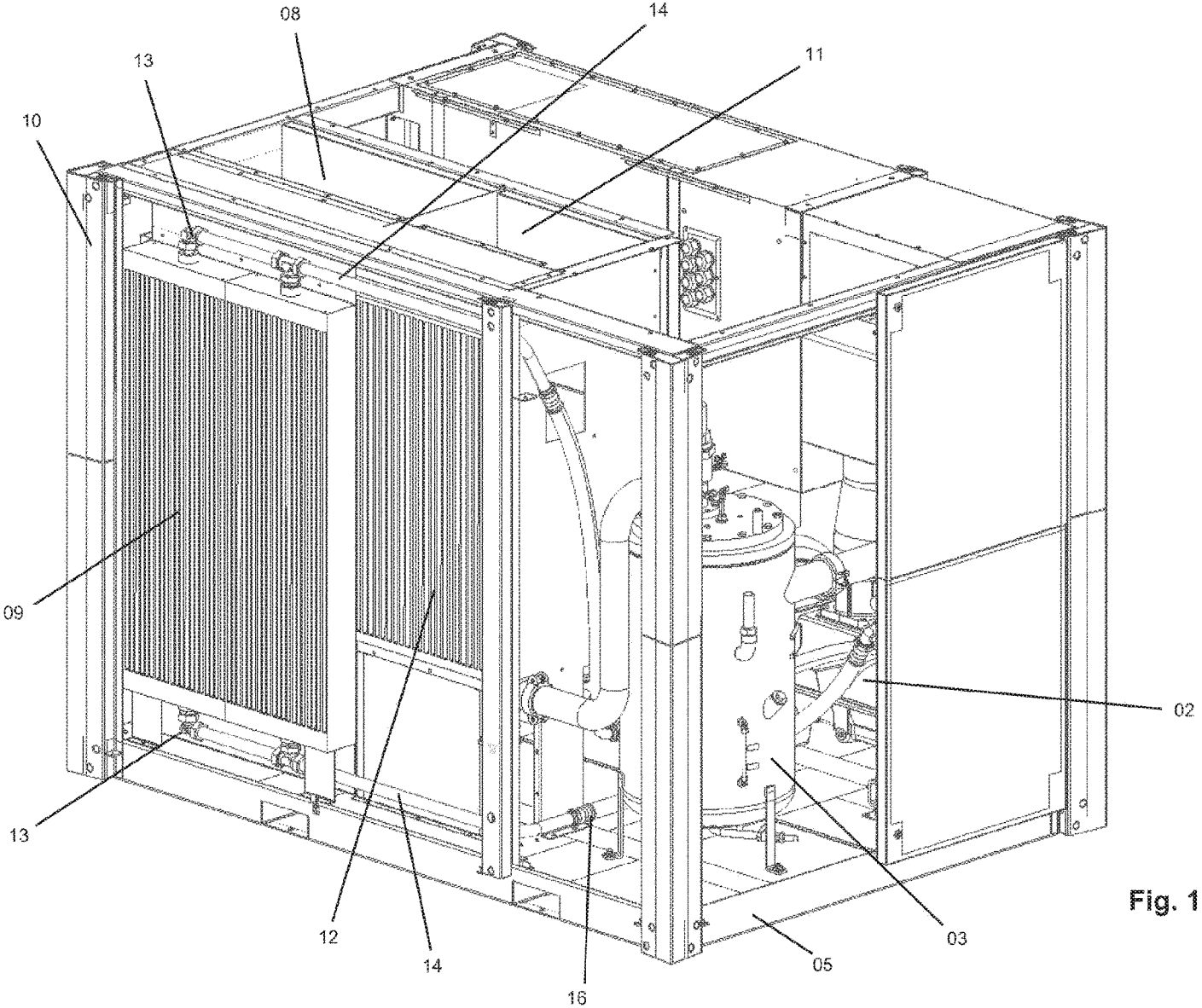

pressed air cooler have an arrangement that is offset to one another in such a way that the axes of their inflow and outflow flanges, arranged on their lateral walls, are located in different planes. The invention also relates to a method for operating a compressor system that generates compressed air, wherein at least two control signals that are independent of one another are provided for two blowers.

9 Claims, 2 Drawing Sheets

(51) Int. Cl.
*F01C 21/00* (2006.01)
*F04B 41/06* (2006.01)

(52) U.S. Cl.
CPC ..... *F04C 29/12* (2013.01); *F04B 41/06* (2013.01); *F04C 2270/20* (2013.01)

(56) References Cited

U.S. PATENT DOCUMENTS

| | | | | |
|---|---|---|---|---|
| 2002/0106288 | A1 | 8/2002 | Lucas et al. | |
| 2010/0135840 | A1* | 6/2010 | Fujimoto | F04B 39/0033 418/201.1 |
| 2010/0303658 | A1 | 12/2010 | Ito et al. | |
| 2012/0090340 | A1 | 4/2012 | Okamoto et al. | |
| 2014/0245982 | A1 | 9/2014 | Haefner et al. | |
| 2015/0030491 | A1 | 1/2015 | Desiron | |
| 2018/0030984 | A1* | 2/2018 | Sato | F04B 41/00 |

FOREIGN PATENT DOCUMENTS

| | | | |
|---|---|---|---|
| CN | 203081708 | U | 7/2013 |
| CN | 103890344 | A | 6/2014 |
| DE | 10117790 | A1 | 10/2002 |
| JP | 2012047185 | A | 3/2012 |
| JP | 2015038354 | A | 2/2015 |

* cited by examiner
† cited by third party

COMPRESSOR SYSTEM FOR GENERATING COMPRESSED AIR, AS WELL AS METHOD FOR OPERATING A COMPRESSOR SYSTEM THAT GENERATES COMPRESSED AIR

CROSS-REFERENCE TO RELATED APPLICATIONS

This is a U.S. national stage entry of International Patent Application No. PCT/EP2016/056850, filed on Mar. 30, 2016, which claims priority to German Patent Application No. 10 2015 104 914.7, filed on Mar. 30, 2015, the entire contents of all of which are fully incorporated herein by reference.

The present invention relates to a compressor system for generating compressed air. Such a system comprises a drive, a compressor powered by the drive, a lubricant cooler for cooling a lubricant, a compressed air cooler for cooling the generated compressed air, and a blower unit for providing cooled air to the lubricant cooler and the compressed air cooler.

The invention also relates to a method for operating a compressed air generating compressor system, which is configured to activate the blower of a blower unit, in order to provide cooled air for the lubricant cooler and the compressed air cooler.

It is known from compressor systems available on the market that such a system comprises a cooling unit in addition to a drive in the form of an electric motor, and a compressor, which is necessary for cooling both the lubricant (preferably oil) needed in the compressor as well as the compressed air provided by the compressor. In known compressors that have oil injection, the lubricant is heated substantially in the compression process, which must be subsequently filtered out of the generated compressed air and cooled, in order to be resupplied to the process at a reduced temperature. If the lubricant is not cooled, the compressor system will quickly become overheated, such that the efficiency may be decreased, and the compressor system may become damaged. Furthermore, the compressed air that is to be generated is heated in the compression process, wherein there is normally the desire to conduct the compressed air at a reduced temperature to the downstream points of use. The temperature of the compressed air supplied by the compressor system normally should not exceed 10-15° above the ambient temperature, such that an efficient cooling of the compressed air is already necessary within the compressor system. In the compressor systems available on the market, separate oil coolers and compressed air coolers are therefore provided, through which cooled air generated by one or more blowers flows. The oil cooler and the air cooler are normally positioned in a shared plane thereby, such that they lie collectively on an outer surface of the compressor system, in order to discharge the waste heat as efficiently as possible. The inward facing sides of the oil cooler and the compressed air cooler adjoin a shared cooling chamber, through which the cooled air flows. In order to enable a compact construction of the known compressor systems, the blower is normally mounted with its rotational plane perpendicular to the coolers (the axis of the blower wheels thus runs parallel to the main plane of extension of the two coolers), in order that the cooled air can be conducted over a short distance, and does not need to be conducted through the entire housing of the compressor system. The conveyance power of the blower must be controlled in the known systems as a function of the respective larger heat discharge quantities that must be regularly discharged from the lubricant cooler. A separate control of the cooling air flow conducted through the compressed air cooler or the lubricant cooler is thus not possible.

A compressor is known from US 2015/0030491, in which a section of a load line is configured as a radiator, which is cooled by an active air flow from a first ventilator. A section of an oil return line is likewise configured as a radiator, which is cooled by a second ventilator.

DE 101 17 790 A1 shows a compressor system that has two compression stages and an intermediate cooler for compressed air following the first compression stage, and an aftercooler for the compressed air following the last compression stage. The two coolers are subjected to cooled air by ventilators, wherein means are provided for regulating the amount of cooled air for the intermediate cooler and the aftercooler.

One object of the present invention, based on these known compressor systems, is to provide an improved compressor system, which provides a more efficient and energy conserving cooling for both the generated compressed air and the lubricant. Preferably, the production and installation efforts for the compressor system should not increase thereby. Moreover, it is intended that the compressor system is configured such that a simple integration in client-specific applications is possible, and the requirements with respect to a simple start-up and maintenance are fulfilled thereby.

A further object of the present invention comprises the provision of a method for operating a compressor system that generates compressed air, which enables a resource-conserving operation and an optimization in the field of cooling the compressor system.

These and further objectives are achieved by a compressor system according to the embodiments disclosed herein.

The compressor system according to the invention for generating compressed air is distinguished in that the blower unit has at least two blowers that can be controlled independently, each of which convey separately cooled air into separate cooling chambers. The first cooling chamber is configured such that it conducts the cooled air conveyed by a first blower to the lubricant cooler, while the second cooling chamber conducts the cooled air conveyed by a second blower to the compressed air cooler. In a suction mode, the cooled air is alternatively conveyed not toward the coolers, but rather away therefrom, likewise via the cooling chambers, which are separated in terms of flow. This reverse operation is likewise encompassed by the invention, as a matter of course, without having to differentiate between these variations below. This has the advantage, firstly, that the individual blowers can be operated independently, in order to adjust the respective volume flows, necessary, on one hand, for cooling the lubricant, and on the other hand for cooling the compressed air cooler, to the respective needs. By way of example, the lubricant cooler requires a large amount of cooled air, if a high compression is desired, while the compressed air cooler requires only a limited amount of cooled air, when only a low amount of compressed air is discharged from the compressor system.

According to the invention, the lubricant cooler and the compressed air cooler are offset to one another, such that the axes of their respective inflow and outflow flanges attached to the lateral walls of the cooler are located in different planes. It is advantageous, in particular, when the main planes of extension of the lubricant cooler and the compressed air cooler are offset to one another by at least the diameter of the connecting lines connected to the further cooler disposed in the interior of the compressor system. This allows for these connecting lines to pass by the other cooler, which is disposed further out, toward the exterior of the compressor system, without being constricted, in a straight line. This ensures not only a simple installation in the production of the compressor system, but also, constrictions and direction changes in the connecting lines are avoided, such that the medium conveyance is optimized.

According to a preferred embodiment, the blower wheel axes of the two blowers are perpendicular to the main planes of extension of the coolers dedicated thereto. The plane in which the blower wheel of a radial ventilator that is preferably to be used is parallel to the main plane of extension of the dedicated cooler thereby. As a result, it is ensured that the cooled air flows through the cooler, preferably running parallel to a lateral wall of the compressor system, and is suctioned toward an upper surface of the compressor system running perpendicular thereto, or is discharged therefrom, without having to flow through the rest of the structural space of the compressor system. An unintentional thermal or dust load to the further components of the compressor system with the waste heat discharged by the coolers is avoided as a result.

In an advantageous embodiment, the compressor system has a base plate and a rack. The individual components or modular structural units are mounted on the base plate. This provides for a modular construction, such that the compressor system can be adapted, for example, to the performance of the drive and the compressor can be adapted to the respective application conditions. The rack can likewise be used to attach the modules, but is primarily intended for retaining the housing parts.

According to a particularly preferred embodiment, the at least two blowers, the first and second cooling chambers, the lubricant cooler, and the compressed air cooler are combined to form a self-contained cooling module. The cooling module is attached to the base plate and/or the rack. In particular for maintenance work, the cooling module of the compressor system can simply be removed.

In accordance with the method according to the invention for operating a compressor system that generates compressed air, at least two independent control signals are provided for two blowers by a control unit. The first control signal is generated as a function of the temperature of a lubricant, and controls a first blower, which supplies a lubricant cooler with cooled air. In this manner, the cooled air volume flow for the lubricant cooler can be controlled in an optimal manner for cooling the lubricant to a predetermined operating temperature. Furthermore, the method supplies a second control signal, which is a function of the temperature of the cooled air that is generated, and activates a second blower. The second blower supplies the compressed air cooler with cooled air, such that the cooled air volume flow for the compressed air cooler can be controlled in an optimal manner for cooling the compressed air to a predetermined service temperature.

Figure 2:
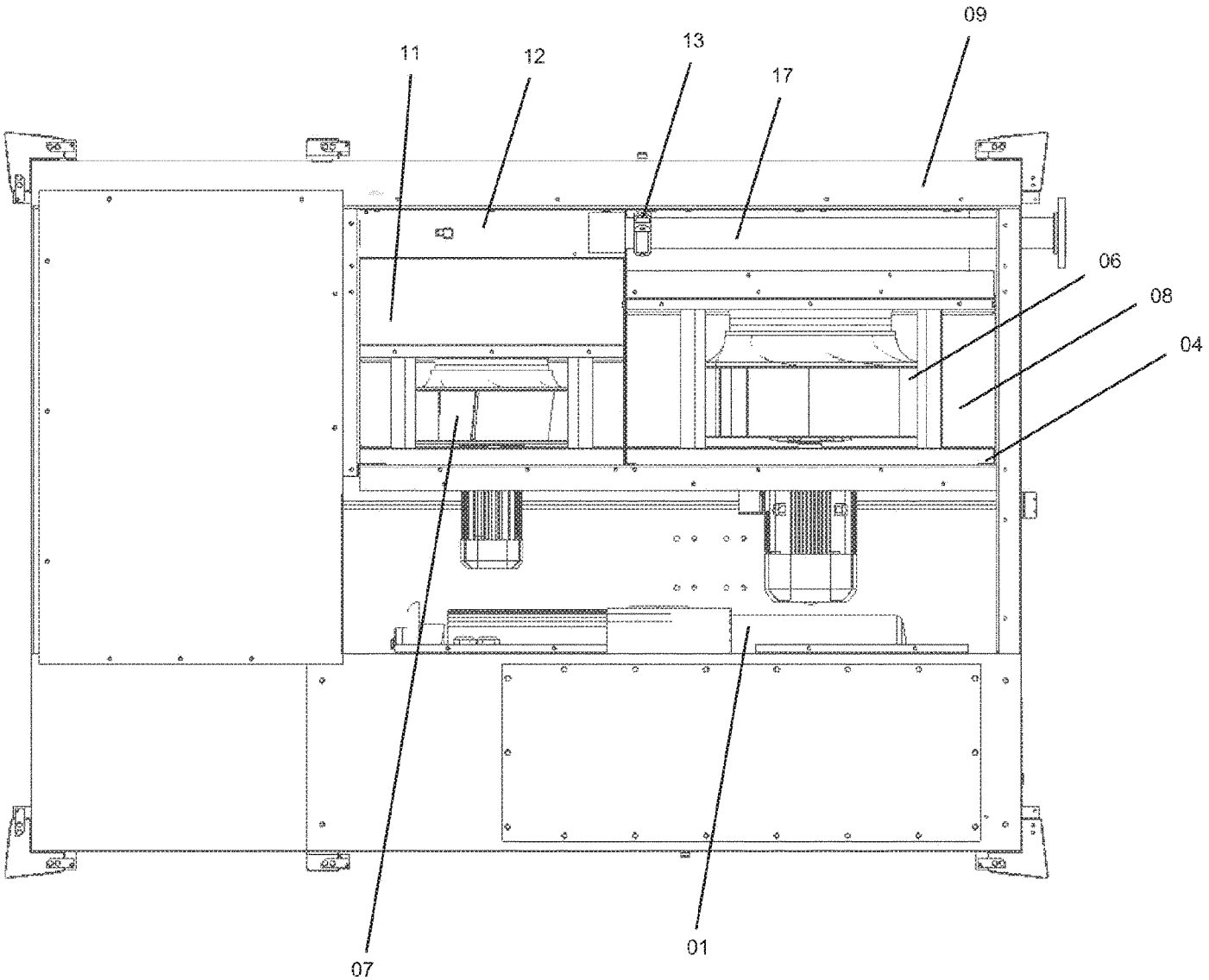

Further advantages, details and developments of the present invention can be derived from the following description of a preferred embodiment, with reference to the drawings. Therein:

FIG. 1: shows a perspective view of a compressor system according to the invention; and FIG. 2: shows a view of the compressor system from above.

The following description of the details of the embodiment shown by way of example of a compressor system according to the invention refers to both of the FIGS. 1 and 2. The fundamental components of the compressor system are known to the person skilled in the art, such that they need only be described insofar as their details, or their interactions are necessary for an understanding of the invention.

The compressor system has a drive 01, preferably configured as an electric motor. The drive 01 interacts with a compressor 02, in which ambient air is condensed and provided as compressed air. The compressor 02 is preferably a liquid injected compressor, and comprises a pressure reservoir 03, which serves as a buffer for the compressed air that has been generated. These units are attached to a base plate 05.

Furthermore, the compressor system comprises a cooling module 04, which is preferably constructed as an self-contained module, and contains the components explained below. A blower is a component of the cooling module 04, which comprises a first blower 06 and a second blower 07 in the depicted example. The first blower 06 conveys cooled air via a first cooling chamber 08 to a lubricant cooler 09, such that the cooled air flows through the lubricant cooler 09. The cooling module 04 is attached to an outer rack 10, for example.

A second cooling chamber 11 is formed separately, in terms of flow, from the first cooling chamber 08, via which the second blower 07 conveys cooled air to a compressed air cooler 12. The main planes of extension of the lubricant cooler 09 and the compressed air cooler 12 are oriented parallel to a lateral wall of the compressor system, running parallel to one another, but with a predetermined offset, such that the lubricant cooler 09 lies further out, and the compressed air cooler 12 lies further in, in the compressor system. The courses of flow through the two coolers 09, 12, the dedicated cooling chambers 08, 11, and the associated blowers 06, 07 are thus parallel but independent of one another. As a result, it is possible to activate the first blower 06 independently of the second blower 07, and to adjust the respective cooled air volume flow to the specific needs of the lubricant cooler 09 and the compressed air cooler 12.

It can be seen in FIG. 1 that the lubricant cooler 09 has two inflow and outflow flanges 13 on its upper surface and its lower surface, via which the lubricant that is to be cooled, in particular oil, is supplied to the lubricant cooler 09, or discharged therefrom in the cooled state. The lubricant lines 14 leading to the lubricant cooler 09 run in a straight line in the region of the cooling module 04, in the plane of the lubricant cooler 09, and require no deflections, angle pieces, or suchlike. Flexible hoses 16 can be connected to the lubricant lines 14, which conduct the lubricant to the other units of the compressor system.

As can be seen in FIG. 2, the compressed air cooler 12 in the depicted example is disposed such that it is offset in relation to the lubricant cooler 09 by approximately the thickness of the lubricant cooler 09. The compressed air cooler 12 likewise has inflow and outflow flanges 13 on its left-hand and right-hand lateral surfaces, to which compressed air lines 17 are connected. The compressed air line 17 leading from the compressed air cooler 12 to the outer surface of the compressor system can pass in a straight line, and without constrictions, along the inward facing side of the lubricant cooler 09 due to this offset. This provides for a simple assembly, the use of inexpensive compressed air lines, and the shortening of the line paths. By avoiding constrictions and deflections in the compressed air line 17, undesired noises can also be prevented in the removal of the compressed air. Furthermore, in many cases it is desirable when the compressed air line is available on a lateral surface of the compressor system for connection to the units to be supplied with compressed air.

It is clear that in modified embodiments, the offsetting of the lubricant cooler and compressed air cooler can also take place in the reversed sequence, such that the compressed air cooler lies further outward, and the lubricant cooler lies further inward. The compressed air cooler is normally smaller, such that it is convenient to place it in the manner described above.

LIST OF REFERENCE SYMBOLS

01—drive
02—compressor
03—pressure reservoir
04—cooling module
05—base plate
06—blower
07—blower
08—cooling chamber
09—lubricant cooler
10—rack
11—cooling chamber
12—compressed air cooler
13—outflow flange
14—lubricant line
15—
16—hose
17—compressed air line

What is claimed is:

1. A compressor system for generating compressed air, comprising:

a drive;

a compressor powered by the drive;

a lubricant cooler including inflow and outflow flanges positioned on opposing lateral walls thereof, each flange having an associated axis therethrough, the lubricant cooler connected to the compressor for cooling a lubricant;

a compressed air cooler including inflow and outflow flanges positioned on opposing lateral walls thereof, each flange having an associated axis therethrough, the compressed air cooler connected to the compressor for cooling compressed air generated by the compressor; and a blower unit connected to the lubricant cooler and the compressed air cooler for supplying cooled air thereto, wherein the blower unit has at least two blowers that can be controlled independently, which convey cooled air into separate first and second cooling chambers, the first cooling chamber conveys the cooled air to the lubricant cooler and the second cooling chamber conveys the cooled air to the compressed air cooler, and the lubricant cooler and the compressed air cooler are offset to one another such that the axes of their inflow and outflow flanges disposed on their lateral walls lie in different planes.

2. The compressor system according to claim 1, wherein the at least two blowers include blower wheel axes perpendicular to main planes of extension of the coolers dedicated thereto, wherein the blowers are configured as radial or tangential ventilators.

3. The compressor system according to claim 1, wherein a main plane of extension of the lubricant cooler and a main plane of extension of the compressed air cooler are offset such that at least one connecting line is connected to the cooler disposed further inward in the compressor system runs in a straight line past the cooler disposed further outward.

4. The compressor system according to claim 1, further including a base plate and a rack, wherein housing parts can be attached to outer braces of the rack.

5. The compressor system according to claim 4, wherein the blowers, the first and second cooling chambers, and the lubricant cooler and the compressed air cooler are combined to form a self-contained cooling module, which is attached to the rack and/or the base plate.

6. The compressor system according to claim 1, wherein a compressed air discharge line runs in a straight line from the outflow flange of the compressed air cooler to a compressed air discharge flange opening onto the outside of the compressor system, and is parallel in sections to main planes of extension of the lubricant cooler.

7. The compressor system according to claim 1, wherein the compressor is a compressor with a liquid injection, and in that the lubricant is the liquid that is injected into a compression chamber of the compressor.

8. The compressor system according to claim 1, wherein the drive is an electric motor.

9. The compressor system according to claim 1, wherein the lubricant is oil.

* * * * *